US006293567B1

(12) United States Patent
Menges

(10) Patent No.: US 6,293,567 B1
(45) Date of Patent: Sep. 25, 2001

(54) SNOWBOARD WITH SELECTIVELY ADDED STRUCTURAL COMPONENTS

(76) Inventor: John D. Menges, 3415 SW. Naito Pkwy., Portland, OR (US) 97201

( * ) Notice: Subject to any disclaimer, the term of this patent is extended or adjusted under 35 U.S.C. 154(b) by 0 days.

(21) Appl. No.: 09/161,174

(22) Filed: Sep. 25, 1998

Related U.S. Application Data

(60) Provisional application No. 60/060,161, filed on Sep. 26, 1997.

(51) Int. Cl.[7] ..... A63C 5/03

(52) U.S. Cl. ..... 280/14.21; 280/602; 280/610

(58) Field of Search ..... 280/602, 608, 280/607, 609, 14.21, 610

(56) References Cited

U.S. PATENT DOCUMENTS 5,366,234 * 11/1994 Rohrmoser ..... 280/610
5,427,401 * 6/1995 Liard ..... 280/609
5,573,264 * 11/1996 Deville et al. ..... 280/602
5,580,077 * 12/1996 Dodge ..... 280/607
5,580,078 * 12/1996 Vance ..... 280/608
5,591,509 * 1/1997 Lorenz et al. ..... 428/107
5,782,482 * 7/1998 Andrus et al. ..... 280/602
5,788,259 * 8/1998 Emig ..... 280/609
5,855,389 * 1/1999 Andrus et al. ..... 280/602
5,988,668 * 11/1999 DeVille et al. ..... 280/602
6,059,306 * 5/2000 Metrot et al. ..... 280/602

* cited by examiner

*Primary Examiner*—Brian L. Johnson
*Assistant Examiner*—Bridget Avery
(74) *Attorney, Agent, or Firm*—Robert B. Hughes; Hughes & Schacht, PLLC

(57) ABSTRACT

A structurally reinforced snowboard comprising upper and lower reinforcing components positioned at upper and lower surface regions of the snowboard. The upper and lower reinforcing components have reinforcing strip portions which are vertically aligned with one another. In one preferred configuration, these extend along end side portions of the board and converge toward an intermediate location. In other configurations, these cross with one another. The arrangement improves torsional stiffness of the board, while permitting the desired flexural stiffness profile to be obtained.

11 Claims, 11 Drawing Sheets

STRUCTURAL COMPONENTS MIRRORED ABOUT THE NEUTRAL AXIS OF THE SNOWBOARD.

STRUCTURAL COMPONENTS MIRRORED ABOUT THE NEUTRAL AXIS OF THE SNOWBOARD.

SNOWBOARD WITH SELECTIVELY ADDED STRUCTURAL COMPONENTS

This application claims of provisional application Ser. No. 60/060,161 filed Sep. 26, 1997.

BACKGROUND OF THE INVENTION a) Field of the Invention

The present invention relates to snowboards, and more particularly to snowboards having specially designed structural components which are strategically shaped and positioned to provide improved functional characteristics of the snowboards.

b) Background Art

Snowboards have become increasingly popular on the ski slopes as an option in addition to snow skiing. Snowboards have much in common with snow skis with regard to the basic functions of traveling over the snow surface, executing turns, etc. Yet snowboards have design requirements specific to snowboards.

Like snow skis, snowboards have their own criteria relative to proper flexural and torsional characteristics. Also, snowboards, like snow skis have desired operating characteristics, such as edge hold, easy turn initiation, stability out of the turn, overall stability and dampness (i.e. desirable damping characteristics). There have been various attempts in the prior art to manipulate or modify the designs to obtain certain specific design characteristics. For example, some snowboard flex profiles are manipulated longitudinally by differentiating the core thickness profile from tip to tail. This can make the board softer in the nose and progressively stiffer in the tail in some cases.

It is an object of the present invention to provide selectively and strategically shaped and positioned structural components as part of the snowboard structure to provide a desired balance of operating characteristics, such as those discussed above.

SUMMARY OF THE INVENTION

The structurally reinforced snowboard of the present invention enables the snowboard to have the desired flexural stiffness distribution, while enabling the snowboard to have improved resistance to torsional deformation.

This snowboard comprises a main snowboard structure having a longitudinal axis and a transverse axis. The main snowboard structure comprises:

i) a main forward portion having a front end portion;

ii) a main rear portion having a rear end portion;

iii) an intermediate portion between said front portion and rear portion, said intermediate portion having foot engaging locations thereon;

iv) side edge portions on opposite sides of the main snowboard structure;

v) a core portion extending along a substantial length of the snowboard;

vi) upper and lower surface portions extending along upper and lower surface regions of said snowboard and positioned above and below said core portion.

The reinforcing structure of the snowboard comprises upper and lower reinforcing components located at the upper and lower regions of the main snowboard structure. Each of the reinforcement components comprises at least two reinforcing strips at least in part on opposite sides of the snowboard. Each reinforcing strip has a first outer end portion and a second inner end portion. The outer end portion is located relatively nearer to a related end portion and related side portion of the main snowboard structure, and the second inner end of each strip is located further from the related end portion and the related side portion. Thus the two outer ends of the two reinforcing strips are positioned further from one another and the two inner end portions are positioned closer to one another.

The first and second reinforcing components co-act so that when the snowboard is in a curved turning configuration, improved resistance to torsional deformation is provided. In one configuration, the outer end portions are interconnected by a connecting strip portion proximate to a related end portion of the main snowboard structure. In a specific configuration, the connecting strip portion extends in a curved configuration where the connecting strip portion extends from the outer end portions of the strips toward the related end of the main snowboard structure. More specifically, the related end portion of the snowboard has a rounded perimeter configuration and the connecting reinforcing strip extends adjacent to a rounded edge of the end portion of the main snowboard structure.

At least substantial strip portions of the upper and lower components are vertically and laterally aligned with one another so as to be able to co-act with portions of the main snowboard structure located therebetween.

The core portion of the snowboard is tapered in a manner that the vertical thickness of the core portion diminishes from the intermediate portion to the front and rear end portions. The vertically aligned strip portions of the upper and lower reinforcing components have at least in part substantial alignment components so that the spacing distance between the upper and lower aligned strip portions diminishes in a direction toward a related end portion of the snowboard.

In one preferred configuration, each of the two reinforcing strips has a first strip portion closer to a related end portion of the main snowboard structure and extends substantially parallel and adjacent to related side edge portions, and a second strip portion extends from an end of the first strip portion in a more diagonal direction toward a central location. In one arrangement, the second portions of the two reinforcing strips extend into the intermediate portion of the main snowboard structure. In one arrangement these reinforcing strips from the forward and rear portions of the snowboard interconnect and in another configuration they are spaced from one another.

In another arrangement, each of the two reinforcing strips extends from related side edge portions and cross one another to extend to a location adjacent to the opposite side edge portion. In one such arrangement, the two crossing reinforcing strips extend substantially the entire length of the main snowboard structure.

In another arrangement, the crossing reinforcing strips each have at least one portion of each connecting strip being connected to one another through a connecting strip portion. In this specific arrangement, the connecting strip portion extends transversely across the main snowboard structure.

In the preferred configuration, there is a first set of reinforcing components at the front end of the snowboard and a second set of reinforcing components at the rear end of the snowboard.

DESCRIPTION OF THE PREFERRED EMBODIMENT a) General Description

Figure 1:
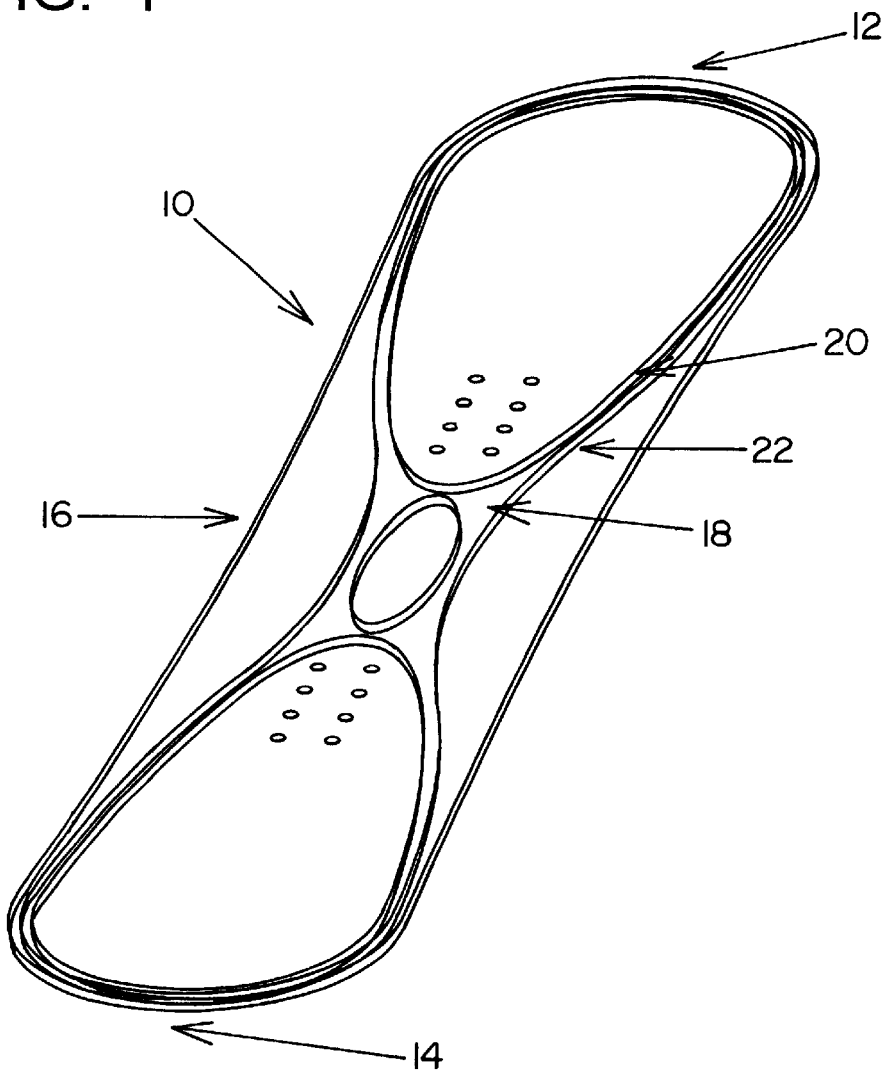
FIG. 1 is an isometric view of the snowboard of the present invention, from a position which is above, behind, and slightly to the right of the snowboard.
Figure 3:
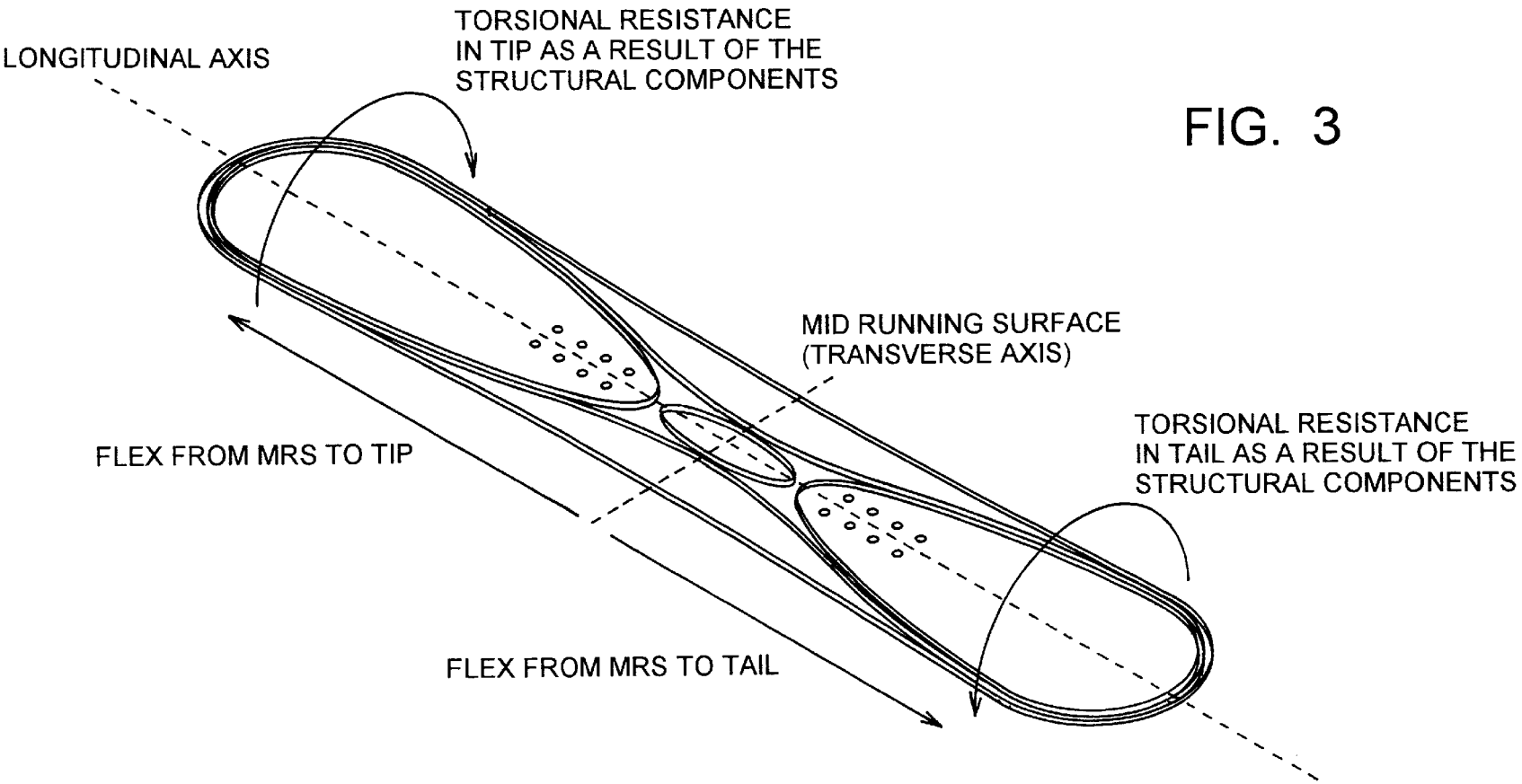
FIG. 3 is another isometric view of the snowboard, this being taken from a location above, and just slightly to the rear and to the left of the snowboard.

With reference to FIGS. 1 and 3, the snowboard 10 of the present invention has a tip 12, a tail 14, and an intermediate portion 16 (i.e. the mid-running surface). The snowboard 10 comprises a main snowboard structure which is, or may be, made of more or less conventional design, but yet specifically structured to cooperate with the components added by the present invention to provide the desired operating characteristics.

There is also shown the selectively shaped and positioned additional structure that is provided in the present invention, this being generally designated 18. In the preferred embodiment, this additional structure 18 comprises upper and lower structural components 20 and 22, respectively. Also in this preferred embodiment, these structural components 20 and 22 are mirror images of one another. However, as will be described later herein, within the broader scope of the present invention, there can be variations from this.

Figure 2:
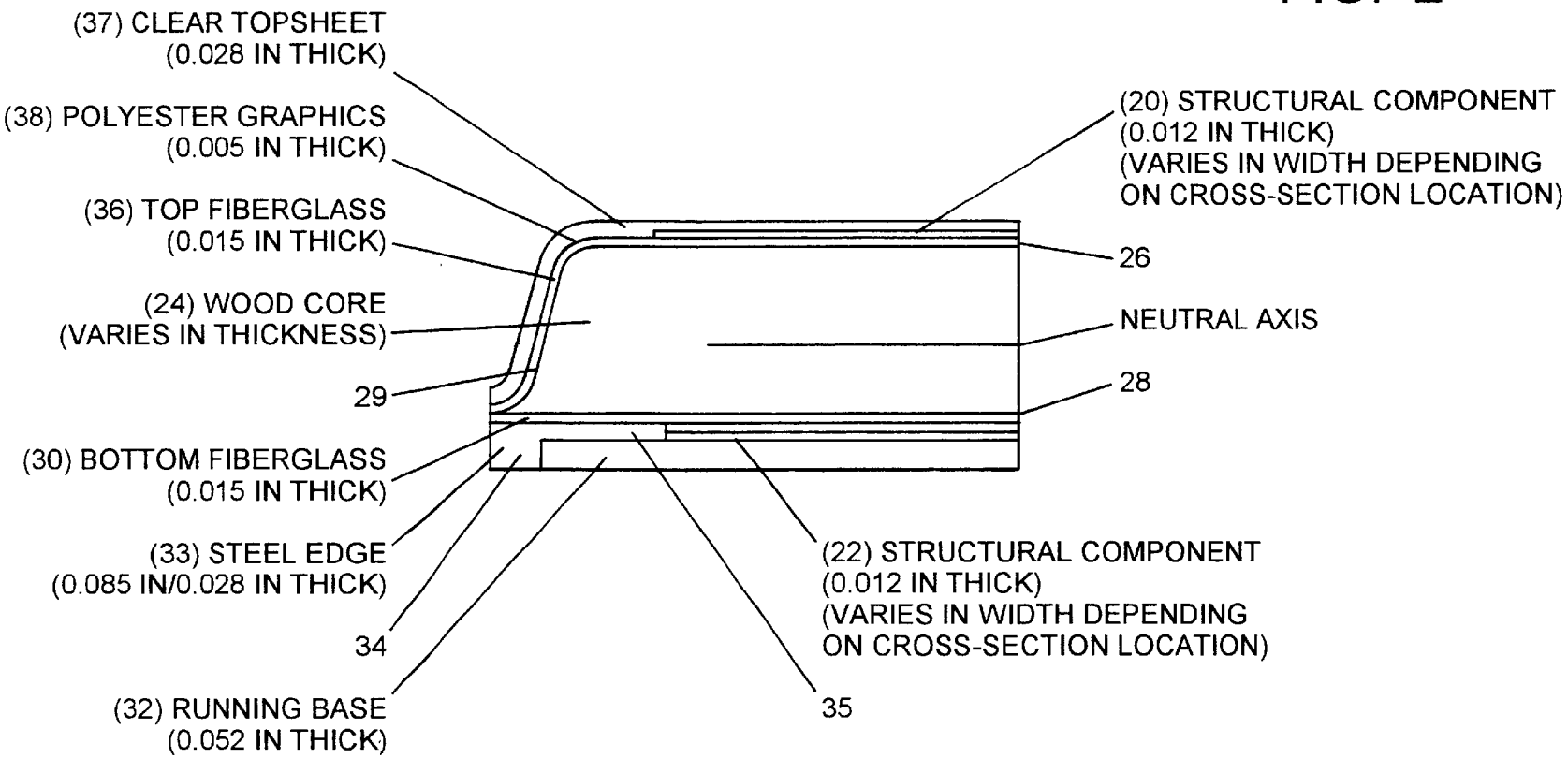
FIG. 2 is a cross sectional view of an edge portion of the present invention, drawn to enlarged scale, and taken along a transverse section line at an arbitrary location along the snowboard.

With reference is now made to FIG. 2, in this preferred embodiment there is a main core 24 which extends from the front tip portion to the tail portion, and also to both side edges of the ski. In this preferred form the main core 24 is made of wood and has a top surface 26, a bottom surface 28, and side surfaces 29 which are, or may be, substantially identical to one another. The depth dimension of the core is greatest at the longitudinal middle portion and decreases generally uniformly toward the tip and tail from about 0.300 inch to 0.075 inch. In a specific embodiment the taper is from 0.252 inch to 0.075 inch. However, depending upon specific design features, these dimensions could vary 5%, 10%, 15%, 20% or 25% from these values either higher or lower, depending on the dimensioning of other components, etc.

Positioned against the lower surface 28 is a bottom layer of fiberglass 30 which extends over substantially the entire bottom surface 28. As shown herein, this can be about 0.015 inches thick. Below the fiberglass 30 is a running base 32 which is, or may be, conventional. Along the side edges of the snowboard are steel edges 33 which are of conventional design, having a main outer edge portion 34 of a square cross sectional configuration, and a laterally inwardly extending flange 35 by which the steel edge 33 is securely bonded in the snowboard 10.

There is an upper layer of fiberglass 36 (0.015 inches thick) positioned against the top and side surfaces 26 and 27 of the core 24, and a clear topsheet 37 about 0.028 inch thick, made of polyethylene and positioned over and around the side edges of the fiberglass layer 36. There is also provided the graphics 38 which are placed on top of the fiberglass layer 36 and under the clear top sheet 37.

In the current process of assembling the board, the board is built from the running base 32 up to the topsheet 37. The components are placed in the mold in the following order; running base 32 (with steel edge 33 pre-bonded to the base), lower structural component 22, fiberglass 30, core 24, fiberglass 36, graphiced polyester 38, top structural component 20, and top sheet 37. Each of these components are wetted out with epoxy resin and hardener previous to the insertion of the press.

b) Description of the Reinforcing Components 20 and 22

We shall now direct our attention to what has been termed the selectively and strategically shaped and positioned additional structure, comprising the two structural reinforcing components 20 and 22. In the preferred embodiment of the present invention, these additional structural components 20 and 22 are made from metal, and more specifically from steel. Accordingly, for convenience, the upper and lower structural components 20 and 22 (in some instances) will simply be called the "steel components", this being done with the understanding that other metals could be used, or even nonmetallic materials having the desired characteristics to function properly in the present invention. It should be noted that there is a direct correlation between the strategical shape of the steel components and specific performance characteristics as will be shown later herein.

Figure 4:
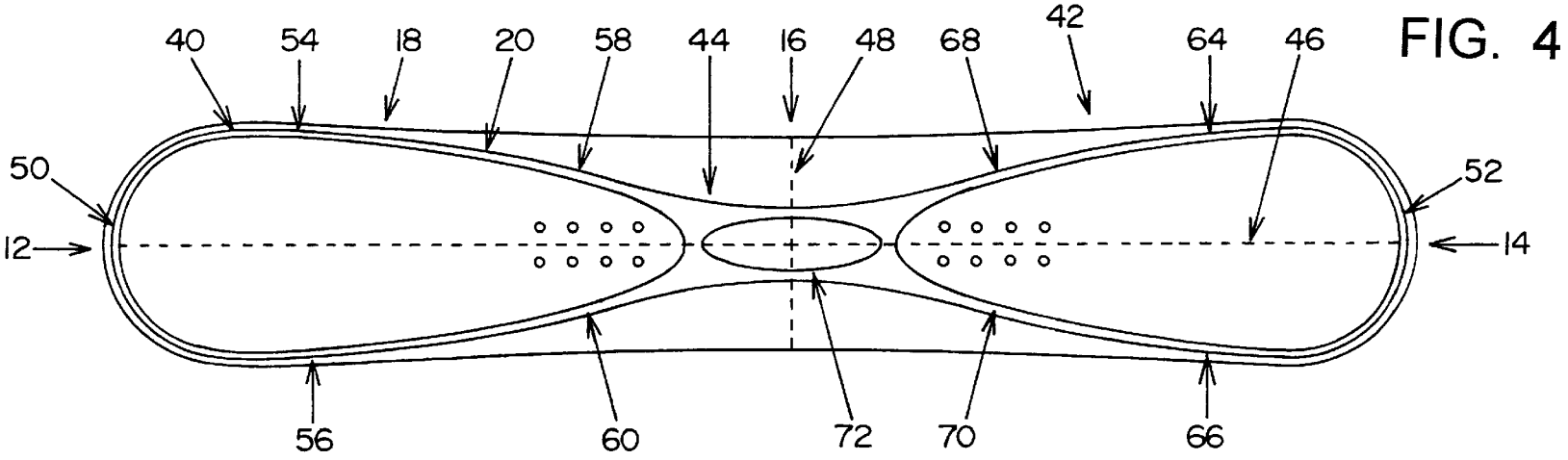
FIG. 4 is a top elevational view of one preferred configuration of the top structural component which is provided by the present invention.

Reference is first made to FIG. 4 which shows the top steel component 20. As shown herein, this steel component has three main sections, namely a front section 40, a rear section 42 and an intermediate section 44. For purposes of description, the snowboard 10 (see FIG. 4) is considered as having a longitudinal center axis 46, and a transverse axis 48 extending through the mid-running surface portion 16.

The front section 40 has a rounded forward part 50 that is formed in an approximate 180° curve and is positioned just inside the front round edge portion 48 of the snowboard 10, and there is a similarly positioned rounded rear part 52. The steel component 20 further comprises two front side sections 53 and 55 which are simply extensions from the front portion 50, and these side sections 53 and 55 comprise forward side portions 54 and 56 which are nearly longitudinally aligned, but slant rearwardly inwardly a slight amount toward the center axis 46. Then the front portions 54 and 56 lead into inwardly and rearwardly slanted transition portions 58 and 60, which in turn join to the intermediate portion 44.

The rear section 42 is shaped very similar to the front section 40, and comprises the rear curved end portion 52 (corresponding to the forward portion 50), side sections 63 and 65 (corresponding to side sections 53 and 55), having near portions 64 and 66 and then transition portions 68 and 70 (corresponding to the sections of the portions 58 and 60).

Figure 5:
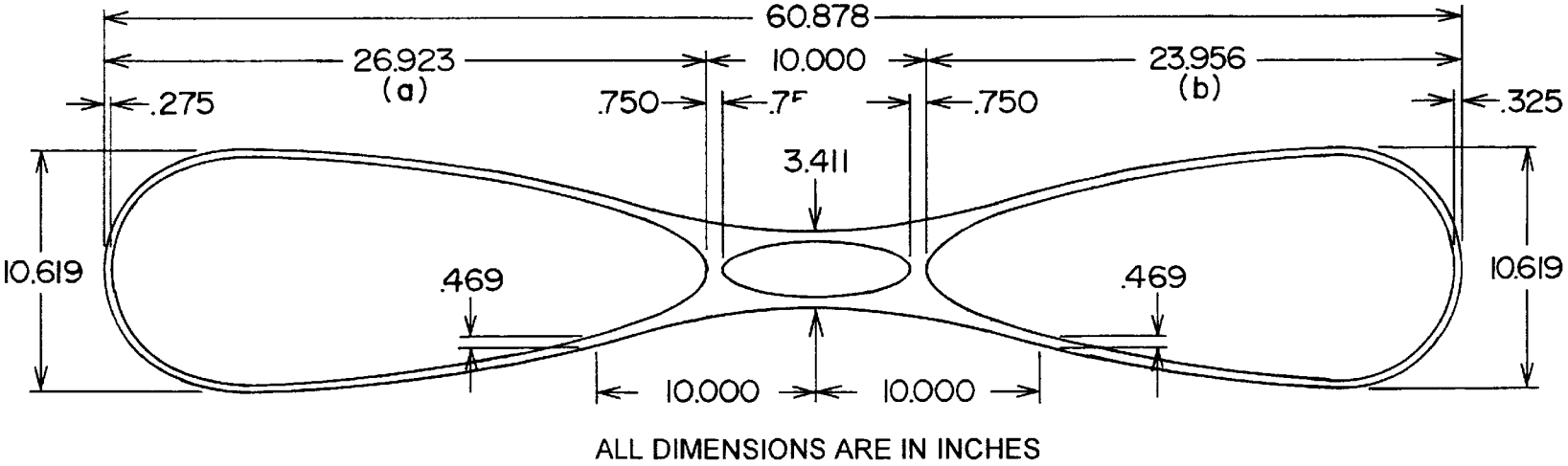
FIG. 5 is a plan view of the bottom added structural component which mirrors the top structural component shown in FIG. 4.

The upper steel component 20 is about 0.012 inch in vertical thickness. In FIG. 5, this upper steel component 20 is shown by itself, drawn to scale. It can be seen that at the forward location 50 it has a horizontal width of 0.275 inch, and at the corresponding rear location a width dimension of 0.325 inch. The front section 40 is moderately longer than the rear section 42. The intermediate section 44 has a longitudinal dimension of about 10 inches, and a width of about 3 and ¼ inch. There is an elliptically shaped opening 72 formed in the intermediate section 44. The dimensions shown in FIG. 5 are accurate dimensions for one preferred embodiment and one part of the disclosure of this invention.

It will be noted from FIGS. 4 and 5 that the width of the upper steel component 20 increases moderately as it comes closer to the intermediate section 44. For example, at the 10 inches both forward and rearward of the transverse axis 48, the width dimension are for the front section 44 of 0.469 and 0.469, respectively, and in the rear sections these are 0.495 and 0.495.

The bottom steel component 22 has the same configuration as the upper steel component 20, so no detailed description of it shall be included herein.

c) Enhanced Performance Attributes

There are five main areas of performance that the strategically shaped and positioned structural components contribute to; these are increase edge hold, easy turn initiation, stability and dampness, responsiveness, and overall weight. In the following sections, it will be described how the shape and position of the steel components correlate to these performance attributes.

Figure 5A:
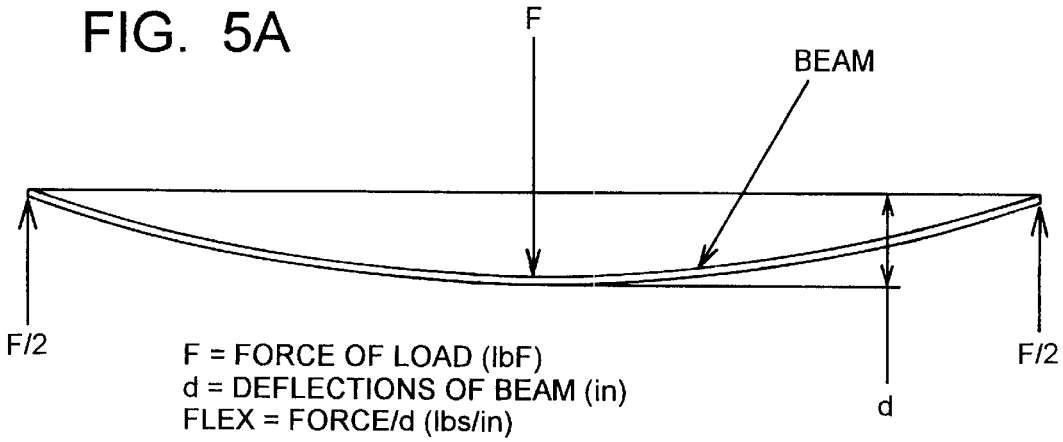
FIGS. 5A and 5B are, respectively, drawings showing the deflection of the snowboard in bending moment and also in torsional bending.
Figure 5B:
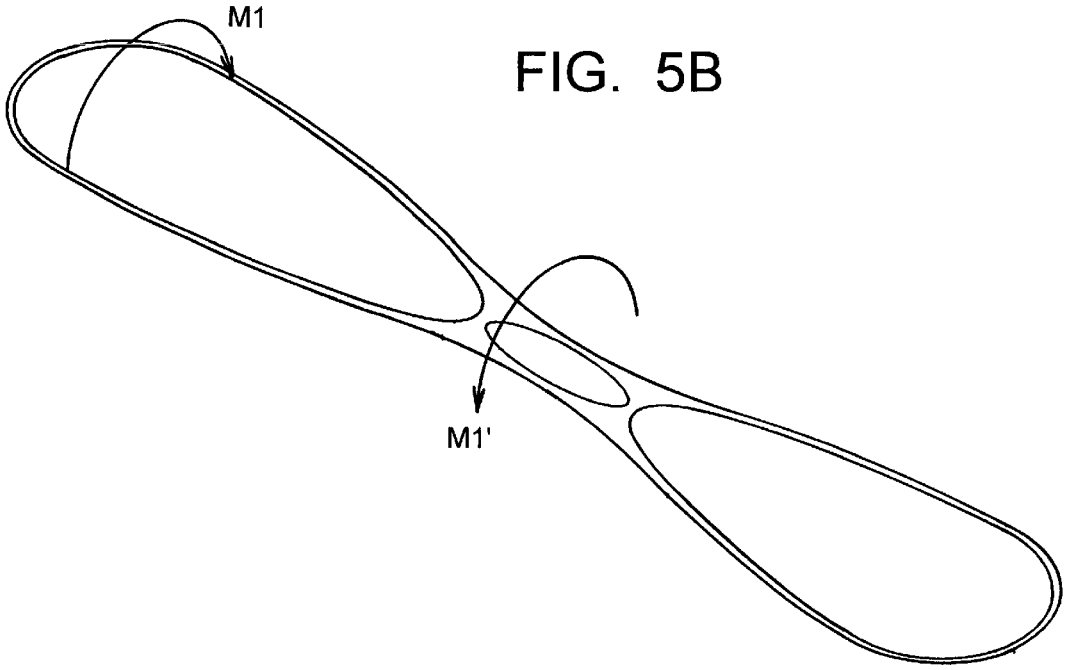

First, it has been proven in ski design that increased torsional resistance by the ski can significantly increase edge hold. Referring to FIGS. 5A and 5B, the snowboard can be represented as a wide beam being subjected to bending (FIG. 5A) and torsional twisting moments (FIG. 5B). In order to increase the edge hold of the snowboard, the structural components should be shaped in a manner to resist the torsional twisting moments M1 and M1' shown in FIG. 5B. This can be done by placing the areas of the steel components 58, 60, 68, 70 (referring to FIG. 4) as close to a 45° degree angle between the longitudinal axis 46 and transverse axis 48 as possible. It can be proven that the torsional resistance of the snowboard can be increased due to the addition of the steel components alone, in comparison with comparable snowboards on the market.

Second, in traditional snowboard design where each component other than the edge extends through the full width of the board, as the torsional resistance is increased by a small amount, the overall longitudinal flex increases a large amount. However, by selectively adding shaped structural component, the overall longitudinal flex can remain soft as the torsional resistance increases. This is turn makes the snowboard initiate a turn easier. It should also be noted that if the tail of the snowboard is progressively stiffer in longitudinal flex compared to the tip, the snowboard will be more stable out of the turn that is initiated. In conventional snowboard design this is done by making the core thicker at the tail than the tip. Within this invention, this difference in stiffness between the tip and the tail can be manipulated by the shape of the structural components. Referring to FIG. 5 note the difference in longitudinal length of the structural component dimension a and b. It follows that because of the difference in this span length, the rear portion 42 is slightly stiffer than the tip front portion 40 giving a progressively stiffer longitudinal flex from the tip 12 and the tail 14.

Third, the shape of the structural components extending into the tip 50 and tail 52, positively impacts the dampness and thus the stability of the board through perimeter weighting of the high modulus material being used. The addition of the structural components in these areas increase the frequency of the snowboard during vibration oscillations making the areas of the board that are not in contact with the snow dampened.

Fourth, an aspect sometimes referred to as "liveliness" or "snappiness" to describe the rebound of a snowboard has to do with the restitution of the materials being used. In other words, when the snowboard is defected through a particular distance (d) from a force of (F) as shown in FIG. 5A, higher modulus materials will want to return at their initial state much more readily. By adding the two mirrored layers of high modulus material this attribute becomes favorable due to the restitution of the components.

Fifth, it is very obvious within the design of the snowboard to make it as light weight as possible without sacrificing any of the performance attributes listed above. By strategically shaping the structural components in a manner to increase torsional stiffness without greatly increasing the longitudinal flex and dampening the tip and tail is done by removing excess material that does not greatly contribute to these characteristics. In the preferred embodiment, it can be proven that the overall weight is reduced by 98% by strategically shaping the structural components instead of using full width and length geometry of this particular material.

d) Manufacturing Advantages

By selectively shaping the structural components of the high modulus material, the capability to change the overall longitudinal flex pattern of the snowboard can be manipulated without changing the core profile thickness. Within the design of a composite cap snowboard, the top surface of the snowboard conforms to the cavity inside the mold. Using this type of cap molding process, new tooling must be made if a change to the core thickness is made to change the flex profile. Using the additional structural components of this invention, the flex profile is manipulated using the shape of the components rather than changing the core thickness. Therefore, the same cavity molds can be used to give a multitude of different flex profiles.

e) Technical Aspects of the Invention

The flexural profile depends, of course, on the resistance of the snowboard to bending vertically about its longitudinal axis at the various longitudinal locations. The forward and rear sections 40 and 42 of the upper and lower steel components 20 and 22, both being bonded to the wood core 20 and positioned one above the other, act in some respects as a beam to resist vertical bending of the snowboard at locations forwardly and rearwardly of the intermediate portion 16. The added resistance to vertical bending provided by the upper and lower sections 40 and 42 depends in part upon the width of the reinforcing strips that make up the sections 40 and 42 (assuming that the thickness of the sections 40 and 42 remains constant) and also the vertical spacing between the upper and lower steel components 40 and 42. Thus, it can be appreciated that by properly shaping the steel components 40 and 42 relative to the width dimension at locations along the length of the snowboard, the flexural stiffness profile can be "fine tuned".

With regard to resistance to torsion, an analysis of the present invention indicates that not only the width dimension of the forward and end sections 40 and 42 of the reinforcing components 20 and 22 affect torsional resistance, but also the lateral positioning of the side sections 54 and 56, and also 64 and 66, as well as the lateral spacing and configuration of the transition sections 58, 60, 68 and 70.

To explain this further, the snowboard 10 has "side cut" so that, for example, the lateral dimension at the center portion 44 is 9.764 inches, with the maximum lateral dimensions at the forward and rear portions being 11.333 inches. As is well known with respect to both snow skis and snowboards, with this side cut, the person can execute a turn by tilting the snowboard 10 to one side or the other so that the lower edge bites into the snow, with the edge assuming a curved configuration because of the side cut. The steeper the angle of the snowboard from the horizontal becomes, the greater is degree of curvature at the snow engaging edge of the snowboard.

As indicated previously, it has been found that the present invention provides greater resistance to torsion. The analysis of how loads are transmitted into a snowboard under various conditions can become somewhat complex. The following discussion is given to present at least a partial explanation, but which may be incomplete or inaccurate in some respects. However, whether or not the explanation which follows is not fully accurate, and/or is not complete, it is believed that it can be presented with reasonable justifications as at least a partial explanation of the features which account for the benefits obtained by the present invention.

As a preliminary comment, the present invention has the reinforcing components 20 and 22 at the top and bottom of the snowboard, so that these cooperate with one another in some respects as a beam. However, beyond this, present analysis and testing indicate that this enables these reinforcing components 20 and 22 to better accomplish torsional stiffness relative to flexural stiffness.

With reference to FIG. 6A through 6I, there is given some background discussion of the forces and other matters that are relevant.

Figure 6A:
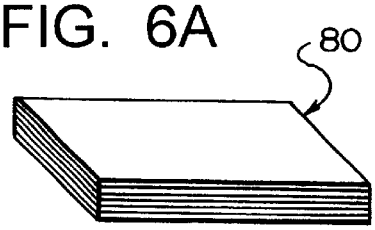
FIGS. 6A through 6M are schematic drawings illustrating various principles relating to deflection of bodies and forces transmitted thereto.
Figure 6B:
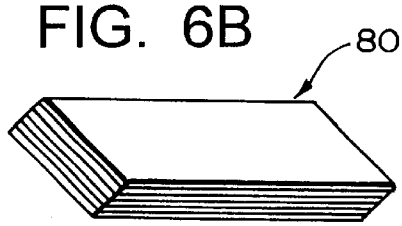
Figure 6C:
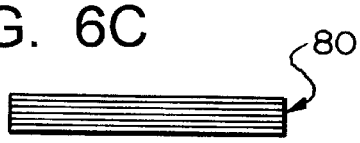
Figure 6D:
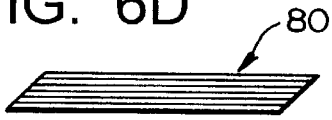
Figure 6E:
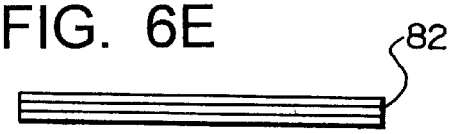
Figure 6F:
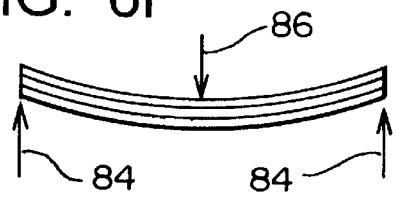

To demonstrate basic principles of shear forces and bending moments, we begin by looking at FIG. 6A which represents a deck of cards 80 where the cards are stacked one on top of another, so as to have an overall configuration of a right angle rectangular prism. FIG. 6B shows the cards having been slid laterally over one another. Since the only force preventing this sliding is the relatively low frictional force between the individual cards, this sliding motion of the cards is easy to accomplish. FIG. 6C is a side elevational view of FIG. 6A, and FIG. 6D is a side elevational view of FIG. 6B.

With reference to FIG. 6E, there is again shown the deck of cards (formed as a somewhat longer, and thinner stack), indicated at 82, and this stack of cards is being subjected to a bending moment by supporting the ends of the cards by the two upward end forces 84, and applying a downward force 86 at the middle. The application of these forces results in what is called as "bending moments". The cards slide rather easily one against the other, so the application of the force 86 is resisted simply by the resistance of the individual cards to bending, and whatever small frictional force there is between the cards which resist these sliding over one another as the bending of the deck of cards 82 is accomplished (see FIG. 6E).

Now let us assume that we bond the deck of cards 82 together by glue so as to make a solid block. Now when the bending moments are applied, as in FIG. 6G, the force 86 in FIG. 6G must be substantially larger to achieve the same amount of bending. The reason for this is that the individual cards stick together so that there is no sliding between the individual cards, but there may be a certain amount of elastic deformation parallel to the length of the cards. In this instance, the cards 82 collectively act as a beam to resist the bending. The cards closer to the upper surface end up being subjected to a compressive force 88, tending to push the right and left portions of the upper part of the card block together, while the lower part of the cards 82 become elongated, and thus have a tension loads 90 applied thereto. At the horizontal middle portion of the deck in FIG. 6G, the shear loads are at zero. The shear forces increase in proportion to the distance longitudinally from the center of the beam.

There are a number of well known principles related to the ability of the beam to provide support. One of these is that for a beam having a rectangular cross section, as the thickness of the beam (in the direction of bending) increases, the resistance to bending of the beam increases in proportion to the depth of the beam squared. Thus, if the rectangular beam is one unit thick vertically (see FIG. 6H), and a second beam (see FIG. 6I), is two units thick vertically, the beam in FIG. 6H would have one quarter of the ability to support a load as a beam in FIG. 6I. The reason for this is that for the beam with the two unit thickness, there is not only twice the amount of material above and below the neutral line to resist the bending, but also the moment arm (the distance from the neutral axis to the locations where the resultant forces above and below the beam resisting bending) are applied has also doubled.

Figure 6G:
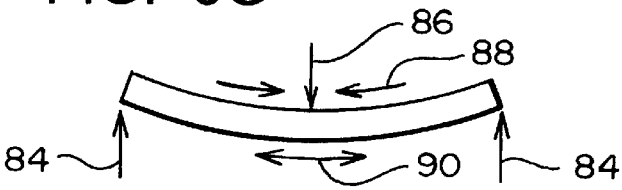
Figure 6H:
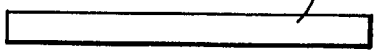
Figure 6I:
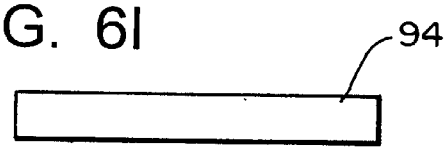
Figure 6J:
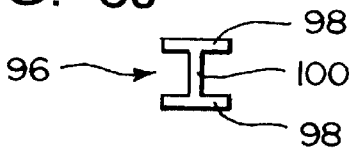
Figure 6K:
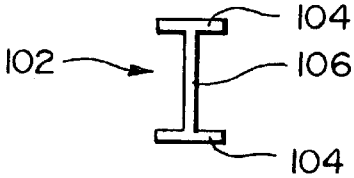

There is another principle regarding beams, and this is illustrated in FIGS. 6J and 6K. FIG. 6J shows an I beam 96 having upper and lower horizontally aligned flanges 98, joined by a vertical web 100. FIG. 6K shows a second I beam 102 having the upper and lower flanges 104 having the same size as the flanges 98 of FIGS. 6J, and having a web 106 which has twice the height of the web 100 in FIG. 6J. The I beam 102 in FIG. 6K does not have four times resistance to bending as the I beam shown in FIG. 6J, but has resistance to bending which is some amount greater than twice as much. The reason for this is that the greater mass of material is concentrated in the upper and lower flanges 98 (in FIG. 6J) and the flanges 104 (FIG. 6K). There is no increase of material in the flanges 98 compared to the flanges 100, but the moment arm doubles. Therefore the resistance to bending provided by the flanges 100 is twice that provided by the flanges 78. The resistance to bending contributed by the web 106, however, compared to the resistance to bending by the web 100 is about four times as great. But with proper design of the beams, the webs 100 and 106 would usually contribute less the resistance to bending, relative to the overall weight of the beam.

This is relevant to the performance characteristics of the present invention, in that we can compare the flanges 98 and 104 to the upper and lower steel components, and compare the webs 100 and 106 to the wooden core. More specifically, as the thickness of the wooden core increases in its vertical dimension, the resistance to bending increases to the square of the depth. On the other hand, the flexural stiffness contributed by the upper and lower reinforcing components 20 and 22 is directly proportional to the space in-between the two.

Figure 6L:
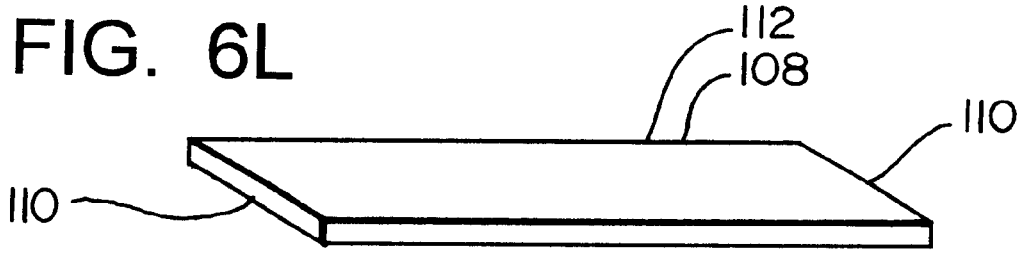
Figure 6M:
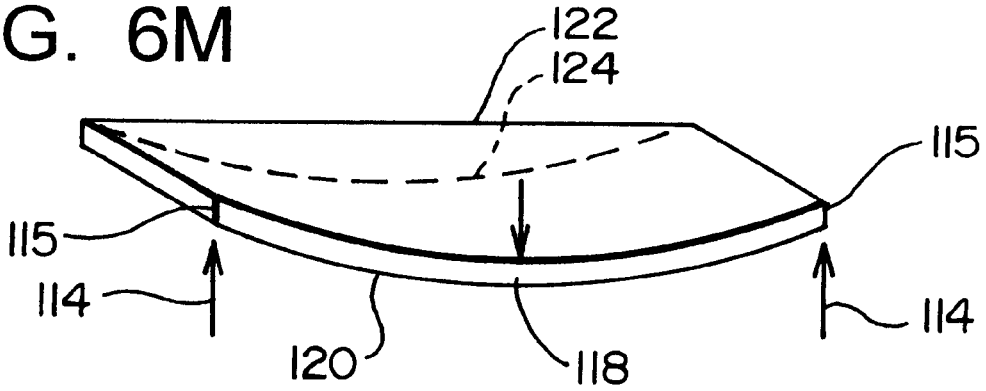

Now our attention is directed to FIGS. 6L and 6M to discuss what happens when we bend the beam by applying the forces only at one longitudinal edge of the beam. In FIG. 6L there is shown, for example, a wooden plank 108 having end portions 110 and a middle portion 112. If two forces are applied as shown at 84 and 86 in FIG. 6G, and if these forces are applied equally along the end edges of the board and equally across the middle of the board, we would expect the board to bend along its length so that there is the same amount of bending at any location transversely across the board.

However, in FIG. 6M the situation is somewhat different in that there are end forces 114 applied at the forward corners 115 of the board 108, and a central downward force applied at the front edge location 118.

In this instance, the board 108 will not bend uniformly. Rather, the forward edge portion will deflect in a curve to a greater degree, as shown at 120, and the opposite longitudinal edge portion 122 will deflect downwardly to a lesser extent, as shown in the broken line 124.

The forces transmitted into the board 108 along the front of the board are reacted substantially in the manner as shown in FIG. 6G where the board will deflect with the material adjacent to the upper surface being compressed, and the material adjacent to the lower surface being elongated. Also, there are shear forces acting along the horizontal plane, and these shear forces would be zero at a central location along the length, and increase outwardly toward the ends of the board.

However, we also have to consider the shear forces which are exerted along a vertical lengthwise plane of the forward portions of the board against the portion of material immediately rearwardly (as seen in FIG. 6M). To simplify this explanation, let us assume the board plank is (as is commonly done with lumber) cut so that the wood fibers extend lengthwise, and these are bonded to one to another by the natural lignin material in the board. Therefore, the shear forces would be exerted along the lengthwise dimension of these wood fibers.

The wood fibers nearest the edge 120 (at the upper side of the board) would be compressed, and these fibers would be acting through shear to the adjacent fibers immediately adjacent to them (as seen in FIG. 6M), so as to compress those fibers also, which in turn would compress the fibers immediately behind, etc. In like manner, the wood fibers at the lower front edge portion of the board 108 would be elongated, and these would tend to elongate the lower adjacent fibers, which in turn would tend to elongate the next adjacent lower fibers, etc. However, as we proceed further along the width of the board (as seen in FIG. 6M) toward the edge 122, the wood fibers would yield to some extent in becoming compressed or elongated, so these compression and tension forces would be diminished at locations closer to the edge 122 of the board (as seen in FIG. 6M).

The manner in which the plank would deform would depend in large part to the character of the material of the board. If the material is highly resistant to shear, then the curving of the board at the edge location 122 (this curve being represented by 124) would be greater. On the other hand, if the resistance to the shear of the board was relatively small, then the curved deflection at 124 would be less.

The situation illustrated in 6M is analogous to what occurs when a snowboard is executing a curve so that the edge of the snowboard that is engaging the snow is curved. However, the situation with the snowboard is somewhat different because of the "side cut" where the lateral edges are formed in a moderate concave curve.

With the foregoing in mind, let us now apply these principles to the manner in which a conventional snowboard reacts these forces when executing a turn. In FIG. 7, there is shown a prior art snowboard 130 where the side cut shown in more typical configuration. However, for purposes of illustration in FIGS. 7B–7F the curvature of the side cut is exaggerated and the rounded tip and tail portions are cut off. The width dimension at the center 132 is half the width dimension of the dimension indicated at 134 where the curvature of the side cut is diminishing.

Figure 7A:
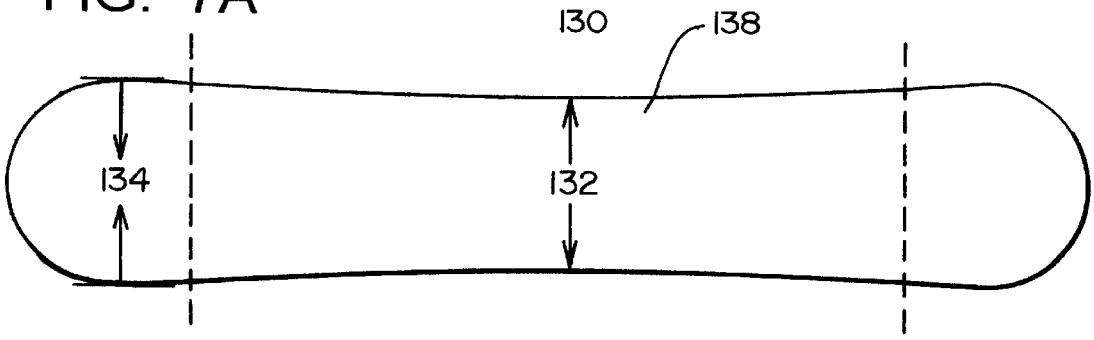
FIGS. 7A through 7F are schematic diagrams illustrating the certain aspects of the performance of the snowboard relative to forces being transmitted therein and the effect of the same.
Figure 7B:
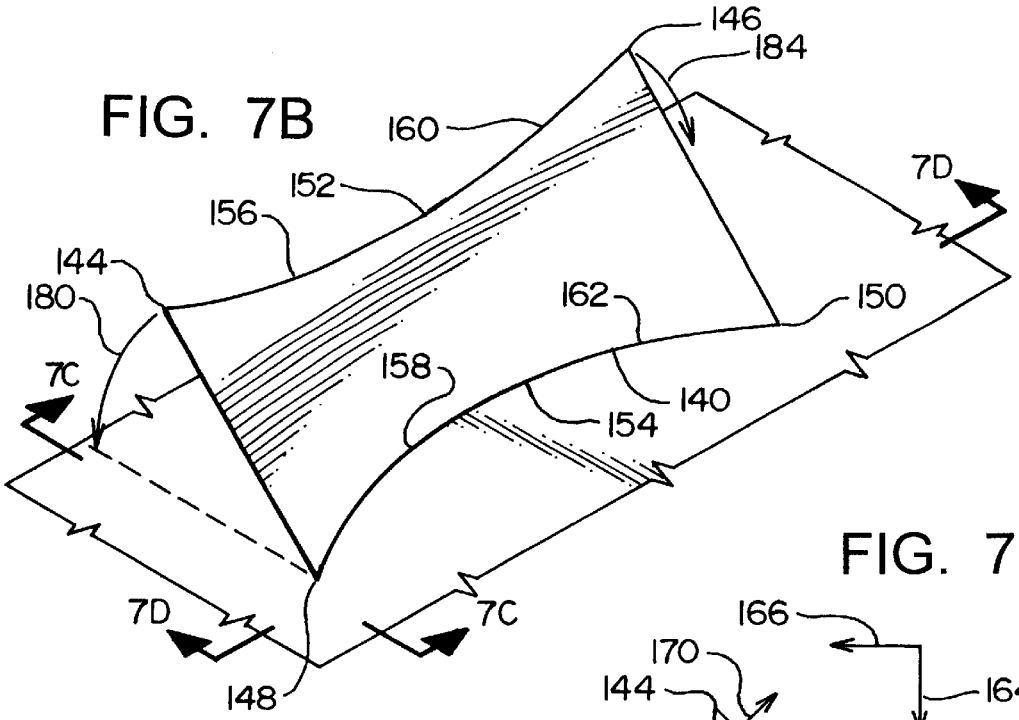

When the turn is being executed, the weight of the snowboarder is shifted so that the snowboard is tipped on its side. With reference to FIG. 7B and following, let us assume that the snowboard is being tipped up on its left side 140, so that the opposite side 142 is raised from the snow surface. FIG. 7B is an isometric view looking at the snowboard section 138 from a location in front of, above, and somewhat to the left of the snowboard section 138, which is bent in a curved configuration along its length as the snowboarder is executing a turn to the left.

Figure 7C:
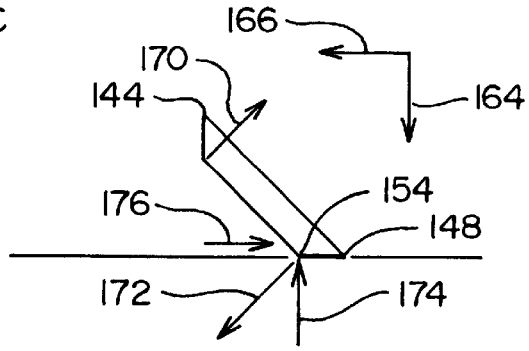
Figure 7D:
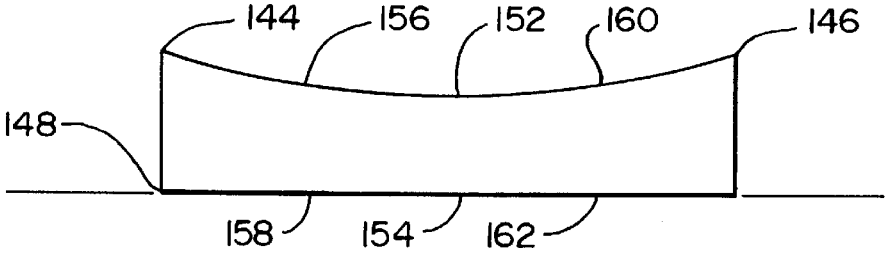

FIG. 7C is a side elevational view taken at the location of the line 7C—7C, and FIG. 7D is a front elevational view, taken at the location of the line 7C—7C in FIG. 7B. For purposes of analysis (with reference to FIG. 7B) several locations along the snowboard section 138 will be identified. First, there are the upper and outer corners 144 and 146, and the lower outside corners 148 and 150. Then there are the middle side locations, namely a raised middle location at 152 and a lower middle location 154 which, as shown in FIGS. 7B through 7D, is positioned against the snow surface. Then there are front and rear intermediate edge locations, positioned half way between the mid-points 152 and 154, and the corner locations 154, 148 and 146, 150, the front side locations being indicated at 156 (a raised location), and 158 (a lower location), and the rear side locations being indicated at 160 (a raised location), and 162 (a lower location).

As shown in FIG. 7D, the snowboard is shown tilted laterally in making a turn, the forces imposed by the person on the snowboard are first the force 164 of the person's weight, and also the centrifugal force 166 which the snowboarder exerts laterally outwardly. These two forces 166 and 164 are transmitted into the snowboard at the lower edge thereof beneath the person's feet, this edge being indicated in FIG. 7B at 168, but for convenience of illustration these forces are shown spaced away from the location of application. In addition, superimposed on the two force components 164 and 166, there is a moment applied by the person's feet on the snowboard to maintain the snowboard at tilt, this moment being applied by the forces indicated at 170 and 172. The snow surface exerts a resisting force which can be divided into two force components, namely a vertical force component 174 which would be approximately equal to the weight of the person, and also the lateral force component 176 to counteract the centrifugal force 166.

The force transmitted by the person's feet along the edge 168 is distributed desirably, along the entire edge 168 where the steel edge along the edge is engaging the snow surface. In an ideal situation, to carve a perfect curve, the edge 168 would be in a near circular curve without any slippage in the snow so that the snowboard would follow a perfectly curved path over the snow surface.

With the foregoing being given as background information, let us again look at the snowboard which is shown in FIG. 7B and review the forces are being applied and how these are resisted in the snowboard. In FIG. 7B, the snowboard is shown where the snowboard is shown in somewhat of an idealized curve, with the curve being uniform along the length of the snowboard, so that is a substantially cylindrical curve. There has been no deformation in torsion which would have moved the forward upper tip portion 144 and rear upper tip portion 146 downwardly toward the snow surface.

However, the upper edge portion 152 of the snowboard acts like a beam so that the internal forces along that edge 152 try to straighten the edge 152 toward a straight curve, which would mean that the points 144 and 146 would deflect downwardly as shown by the arrows 180 and 184. However, this tendency is resisted in two ways. First, it is resisted in shear, since the elongate wood fibers have resistance to the shear movement. In other words, they do not act like a loose deck of cards, but are joined together to resist the shearing action. Further, the wood fibers are resistant to tension and compression. Nevertheless, there will be some deformation in shear and some deformation in the elongation or compression, so we could expect the tips portions at 144 and 146 to deflect downwardly to some extent. This results in a torsional force such as is illustrated in FIG. 5C. It should be noted that when a torsional force is applied as shown in 5C, the edges that are curved in something of a spiral curve tend to be elongated (since the spiral curve for a given distance is longer than a straight line), and the material along the straight center line tends to be compressed in a longitudinal direction.

It is the function of the added structural components 20 and 22 in the present invention which resist this tendency.

It will be recalled that, with reference to FIG. 7C, the forces 170 and 172 exerted by the snowboarder tilting the board up on its edge maintained the mid points 152 and 154 (see FIG. 7*b*) of the snowboard and alignment. The tendency is for the points 144 and 146 to tip downwardly along the lines indicated at 180 and 184. (it should be remembered that the points 144 and 146 on the actual snowboard not end points, but are connected to the front and rear rounded portions at the tip and the tail of the snowboard.) However, it can readily be seen that if, for example, point 144 rotates downwardly along the path indicated at 180, the board will distort and stretch in a manner so that the point 144 moves further away from the point 154 which is at the mid point of the lower edge of the board that is in contact with the snow. This movement of the point 144 is resisted both by the boards resistance to torsion and also the resistance to elongation. However, to have the desired flexural stiffness along the length of the board, the vertical thickness dimension of the board diminishes in a forward to rear direction. Thus the ability of the board to resist this tendency toward distortion is diminished, particularly toward the end portions of the board. The reinforcing components of the present invention are designed to increase the torsional resistance of the board.

Figure 8:
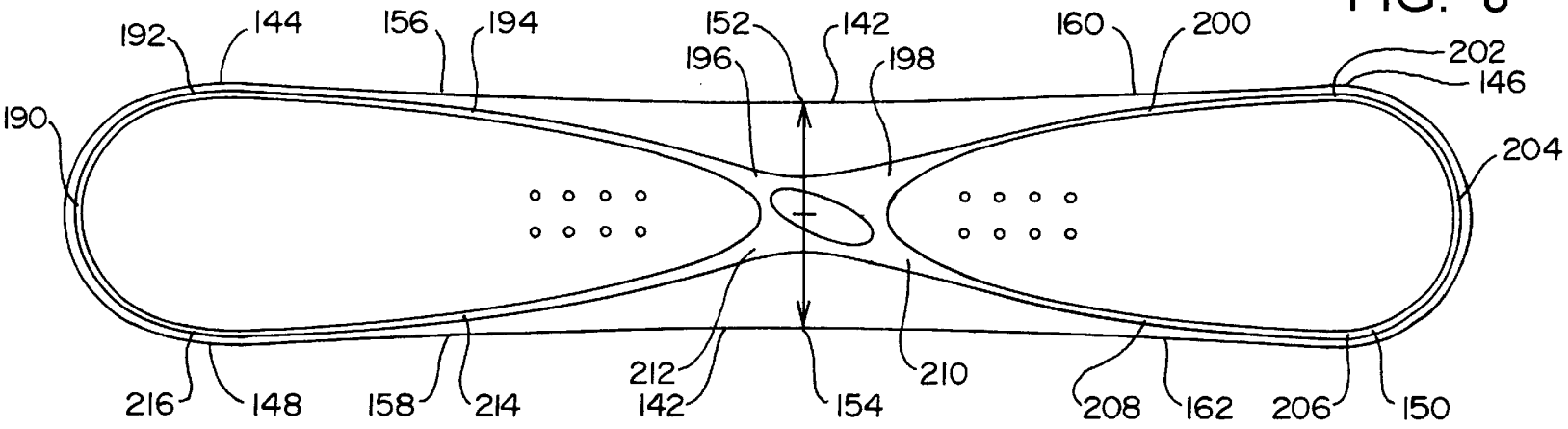
FIG. 8 is a plan view of the snowboard having numerical designations for further description.

To explain this further, reference is made to FIG. 8, where, the previous numerical designations have been omitted, and for ease of explanation, numerals have been added to show various locations along the additional structural components 20 and 22. It is to be recalled that these components 20 and 22 are mirror images of one another, with the component 20 being at the top surface and component 22 being at the bottom surface.

As indicated previously, testing and analysis has indicated that by having the upper and lower structural components 20 and 22 added to the snowboard, the torsional stiffness is increased to a greater degree than the flexural stiffness. Further, by redesigning the other components (for example by reducing the vertical thickness in certain areas) the flexural stiffness can be maintained at the same level (using the components 20 and 22 of the present invention) while the torsional stiffness can be increased. Further, present analysis and testing indicates that the improvement achieved by using the upper and lower components 20 and 22 in combination add more than twice the benefit that would be achieved if only one of these structural components 20 or 22 were used alone.

In FIG. 7B there is indicated at one arrow line 180 the expected curved path that the upper end point 144 would be expected to follow is it were to rotate all the way down to the surface 182. Likewise, at the opposite end there is indicated by the arrow 184 the path that the opposite upper edge point 146 would follow if it were to rotate all the way down to the support surface 182.

To understand the application and resistance to forces in the arrangement of FIG. 7B, the reader is invited to conduct a short experiment by cutting out a pattern of a snowboard as shown it in FIG. 7B, using somewhat stiff paper or thin moderately flexible cardboard. Then about five pieces of tape are used, to tape the snowboard model to the flexible cardboard, to the top of a desk or table in about a 45° curve. The tape should be such so that it would cause the curved edge 140 to remain in contact with the desktop. At this stage, the snowboard paper cut-out should be positioned similar to what is shown in FIG. 7B. Now, if a finger is pressed along the top edge at 156 and try to bend it over, it will be found that the curved paper "snowboard" is very resistant to being bent over.

Figure 7E:
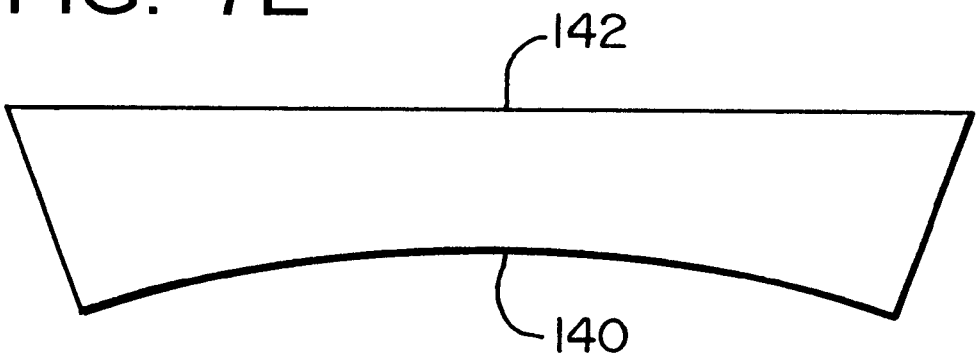

Now, in FIG. 7E there is shown an imagined situation where the snowboard is made of a material that will stretch and compress in a longitudinal direction, but is almost totally resistant to shear, also has maintained its edge 140 in contact with the surface 182, and with this edge 140 intact and still in its curved position, the snowboard has been rotated down to its horizontal position so that the opposite edge 142 is now lying flat against the snow surface. As you can see, the board is distorted far out of shape, and the edge 142 could be elongated by only about 10%, and the opposite edge 24 could be shortened by about 10%. As indicated above, this is obviously an imaginary situation given only for purposes of illustration.

Figure 7F:
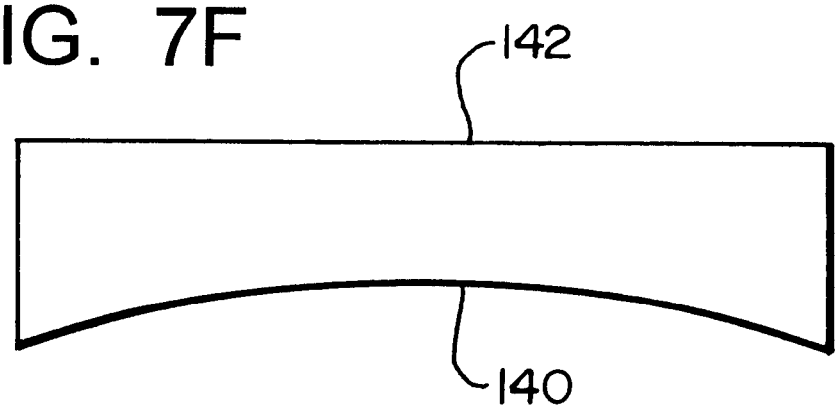

Now let us review the situation in FIG. 7F where the longitudinal fibers yield rather easily in shear, but are neither compressible nor stretchable in a lengthwise direction. In this instance, assuming that the bottom edge is fixedly positioned at the surface so that it won't move laterally, and if the board is pushed down to be flat against the underlying surface, the upper edge 142 will be in a nearly straight line, and the longitudinal fibers of wood would be curved. The front and rear edges would be slanted slightly so that the length of the edges 140 and 142 are the same. This also is simply an imagined situation only for purposes of explanation.

Reference is made to FIG. 8 which shows the snowboard of the present invention in plan view. The numerical designations to show locations on the board illustrated in FIG. 7B are presented in FIG. 8, and additional numerical designations 190 through 216 have been given to indicate various locations along the reinforcing component 20 (it being understood that these same designations will refer to the reinforcing component 20 on the bottom side of the board).

Let us assume that the board of FIG. 8 is now executing a turn so that the front end and rear end are curved upwardly. The lower edge 142 is biting into the snow and is thus held in a curved configuration, and (for reasons indicated previously), there will be a tendency for the front and rear upper board location 144 and 146 to deflect downwardly). This will be due in large part to the upper edge portion 142 acting in itself as a beam with its resistance to bending tending to straighten out the edge 142. However, there is the added effect of the internal fibers of the board acting to resist shear to prevent this from happening. (This was explained previously with reference to 6M).

For reasons indicated previously, if the point 144 begins deflecting downwardly, Then the distance from the point 154 to the point 144 will tend to increase. The structure of the board itself will resist this elongation. Also, the upper and lower reinforcing strips extending from 192 to 196 will resist elongation. At this point, let us examine further the action of the upper and lower strips extending from 192 to 196. In one way, these strips 192/196 act as a beam with the upper strip in compression and the lower strip in tension which would tend to lower the point 144. However, as that happens, as explained previously, there tends to be an elongation from the point 192 to 196, and as soon as this elongation starts taking place, the compressive force on the upper strip portion 192/196 will decrease, while the tension force on the lower strip 192/196 will increase. It is presently theorized, in accordance with the analysis and testing done thus far, that the effect of the upper and lower strip portions 192/196 acting as a beam to push the point 144 downwardly are less significant than the action these two strips 192/196 acting collectively to resist elongation (i.e. stretching from the point 196 to 192 and the board itself resisting the stretching from the point 154 to 144). Thus, it is surmised that these two strips 192/196 add reinforcing to resist that downward movement of the point 144.

Let us also turn our attention to the resistance of the shear forces. As explained previously, with reference FIGS. 7E and 7F, the shear forces acting through the elongate fibers in the wood core resist the downward bending of the point 144. If that bending were to occur, the effect would be that the fibers at the upper edge portion 144 would tend to shift toward the center of the board relative to the fibers toward the lower part of the board at location 148. This also is resisted by the upper/lower reinforcing portions indicated by the numerical designations 190, 192, 194, 196, 212, 214 and 216. The curved end portion 190 being bonded to the upper and lower wooden core, would resist the shifting of the wood fibers in shear. Also, the shear would be resisted in upper strip components 192/196 resisting the shear distortion and tension, while the lower reinforcing strip portion 212/216 is resisting the distortion in shear by resistance in compression.

Figure 9:
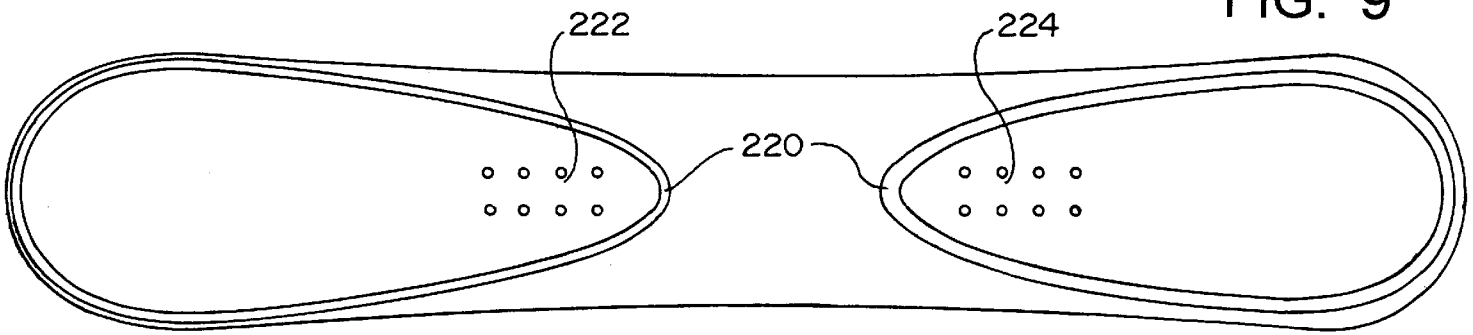
FIGS. 9 through 12 show further embodiments of the present invention.

FIG. 9 shows a second configuration of the snowboard of the present invention. In this configuration, the intermediate section has been eliminated, and the side reinforcing strip portions have been joined together, with the curved connecting portions being indicated at 220 in FIG. 9. It will be noted that these connecting portions 220 are located between the forward and rear locations 222 and 224, respectively, where the bindings for the boots would be positioned. It is believed that the functioning of the reinforcing strips is apparent from the above discussion.

Figure 10:
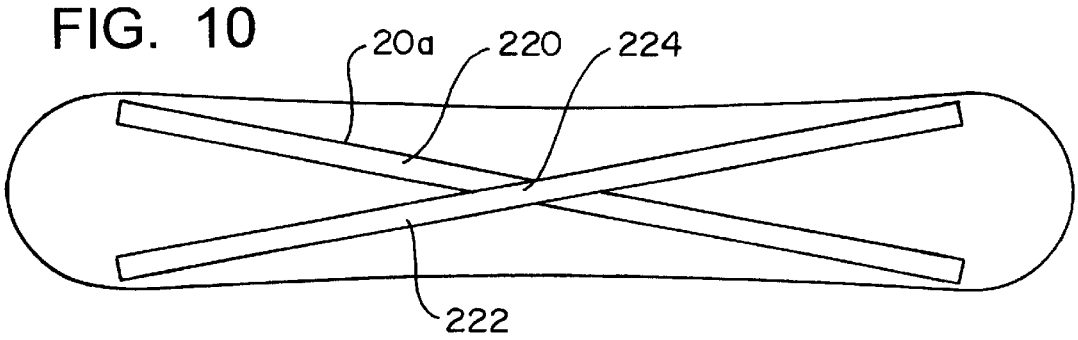

A third embodiment of the present invention is shown in FIG. 10. There are shown upper and lower reinforcing components. In the arrangement of FIG. 9 there are two elongate metallic reinforcing strips 220 and 222 extending substantially the length of the snowboard and intersecting at a middle location 224. It is believed that the manner in which upper and lower reinforcing components transmit the forces and resist the distortion of the board is evident from the above description, so this will be not repeated herein.

Figure 11:
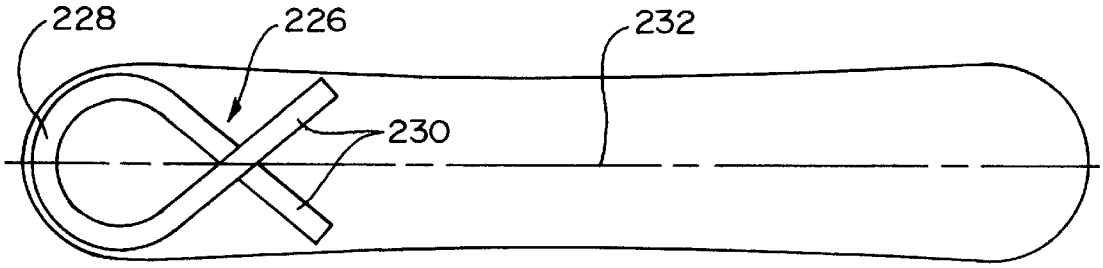

In FIG. 11, there is shown a fourth embodiment. For ease of illustration, there is shown only a more forward section of the upper reinforcement component, generally designated 226, with the understanding, of course, that there is a similar reinforcing component at the bottom surface of the snowboard. This reinforcing component 226 has a forward curved section 228, and this extends in approximately a 270° curve, with the ends of the curve joining to two crossing arms 230. Thus, these arms 230 extend at approximately 45° angles to the longitudinal axis 232. In addition to having the reinforcing components shown at 226, there could be another or similar reinforcing component at the tail end of the ski, and possibly intermediate reinforcing components also. Further, it is to be understood that the angular orientation of the arms 230 could be changed so that these arms 230 extend further toward the central portion of the ski, and thus would make a lesser angle with the longitudinal axis 232.

Preliminary analysis of the arrangement shown in FIG. 10 indicates that the diagonal orientation of these arms crossing one another cooperate advantageously in diminishing the distortion in shear and also diminish unwanted elongation or compression of the snowboard. Further, the circular tip portion 228 acts in the manner of an arch like member where the circular configuration resists the loads which would tend to distort the arch.

Figure 12:
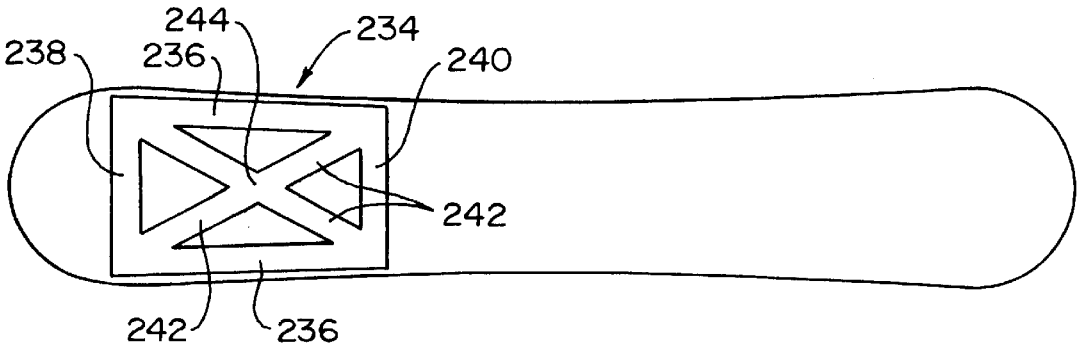

FIG. 12 shows a fifth embodiment showing only the upper reinforcing component 234. It is understood that there would be a similar reinforcing component on the bottom side of the snowboard shown in FIG. 12, and also another reinforcing component (likely a similar reinforcing component) at the rear of the snowboard. In this arrangement, there is a reinforced box like configuration, having two side portions 236, longitudinally aligned, a forward cross member 238, a rear cross member 240, and four diagonal arms 242 which intersect at a central location 244.

It is evident from reviewing the configuration of the reinforcing structure shown in FIG. 12 that this is a triangulated box which is quite effective in resisting distortion and shear. Further, it is to be understood that various modifications could be made to the arrangement shown in FIG. 12. For example, the two side members 236 could omitted so that there would be remaining two triangular members which intersect with one another, which would also be resistant to deformation of the board. Or the forward and rear members 238 and 240 could also be deleted and still obtain substantial benefit.

It is to be understood that various modifications could be made to the present invention without parting from the basic teachings thereof.

What is claimed is:

1. A structurally reinforced snowboard, comprising:

a) a main snowboard structure having a longitudinal center axis and a centrally located transverse axis at a center of the snow board, said main snowboard structure comprising:

i) a main front end section having a front outward end portion at a front end of the snowboard;

ii) a main rear end section having a rear outward end portion at a rear end of the snowboard;

iii) an intermediate portion at an inward location between said front portion and said rear portion, said intermediate portion having foot engaging locations thereon;

iv) side edge portions on opposite sides of the main snowboard structure;

v) a core portion extending along a substantial length of the snowboard;

vi) upper and lower surface portions extending along upper and lower surface regions of said snowboard and positioned above and below said core portion;

b) upper and lower elongate reinforcing components, located at the upper and lower surface regions at at least one of said end section, each component comprising:

i) two reinforcing side portions, each having an inner end portion laterally closer to said longitudinal axis so that the two inner end portions are laterally closer to one another, and an outer end portion further from said longitudinal axis and said transverse axis so as to be closer to a related edge portion of a related end section, so that the two outer end portions are further from one another;

ii) an end reinforcing portion, located near and extending across an end portion of a related end section, and having two end side portions at side locations at the outer end portions of the two reinforcing side members.

2. The snowboard as recited in claim 1, wherein said two end reinforcing portions extend in a curved configuration at a curved outer end portion of a related end portion of an end section of the snowboard.

3. The snowboard as recited in claim 1, wherein at least said reinforcing side portions of the upper and lower reinforcing components are vertically aligned with one another so as to be able to co-act with portions of the main snowboard structure located therebetween.

4. The snowboard as recited in claim 1, wherein there is a second set of upper and lower reinforcing components which are positioned at the end section of the main snowboard structure other than the end section of the snowboard structure at which the upper and lower reinforcing components of claim 1, are located, the second pair of upper and lower reinforcing components being substantially similar to the components recited in claim 1.

5. The snowboard as recited in claim 1, wherein each pair of said two reinforcing side portions have inner end portions extending toward one another and crossing one another.

6. The snowboard as recited in claim 1, wherein at least one end portion of the two reinforcing side portion being connected to one another through a connecting reinforcing strip.

7. The snowboard as recited in claim 2, wherein each of the two outer end portions of the two reinforcing side portions extend substantially parallel and adjacent to related side edge portions of the snowboard structure and the inner end portions of the reinforcing side portions extend in a more diagonal direction relative to said longitudinal axis toward a central location.

8. The snowboard as recited in claim 3, wherein the core portion of the snowboard is tapered in a manner that the vertical thickness of the core portion diminishes from the intermediate portion to the front rear end portions, said vertically aligned reinforcing portions of the upper and lower reinforcing components having at least in part substantial longitudinal alignment components so that the vertical spacing distance between upper and lower aligned strip portions diminishes in a direction toward a related end portion of the snowboard.

9. The snowboard as recited in claim 7, wherein inner end portions of the inner end of the side portions of the reinforcing portions extend into the intermediate portion of the main snowboard structure.

10. The snowboard as recited in claim 9, wherein there is a second set of upper and lower reinforcing components which are positioned at the main end section of the main snowboard structure other than the main end section of the snowboard structure at which the upper and lower reinforcing components of claim 1 are located, the second pair of upper and lower reinforcing components being substantially similar to the components recited in claim 9.

11. The snowboard as recited in claim 6, wherein the connecting reinforcing portion extends transversely across the main snowboard structure.

* * * * *